US006440009B1

(12) United States Patent
Guibaud et al.

(10) Patent No.: US 6,440,009 B1
(45) Date of Patent: Aug. 27, 2002

(54) GOLF CLUB HEAD AND METHOD OF ASSEMBLING A GOLF CLUB HEAD

(75) Inventors: Jean-Marc Guibaud, Annecy le Vieux; Jean-Pierre Rigal, La Balme de Sillingy, both of (FR)

(73) Assignee: Taylor Made Golf Co., Inc., Carlsbad, CA (US)

( * ) Notice: Subject to any disclaimer, the term of this patent is extended or adjusted under 35 U.S.C. 154(b) by 0 days.

(21) Appl. No.: 08/737,928

(22) PCT Filed: May 5, 1995

(86) PCT No.: PCT/FR95/00583

§ 371 (c)(1),
(2), (4) Date: Dec. 4, 1996

(87) PCT Pub. No.: WO95/32765

PCT Pub. Date: Dec. 7, 1995

(30) Foreign Application Priority Data

May 30, 1994 (FR) ..... 94 06780

(51) Int. Cl.[7] ..... A63B 53/04
(52) U.S. Cl. ..... 473/334; 473/349; 473/350
(58) Field of Search ..... 473/328, 334, 473/335, 336, 338, 345, 349, 350

(56) References Cited

U.S. PATENT DOCUMENTS

| | | | | |
|---|---|---|---|---|
| 1,574,213 A | * | 2/1926 | Tyler | 473/338 |
| 1,913,821 A | * | 6/1933 | Stumpf | 473/338 |
| 2,332,342 A | * | 10/1943 | Reach | 473/338 |
| 4,021,047 A | | 5/1977 | Mader | 273/167 H |
| 4,043,563 A | | 8/1977 | Churchward | 273/171 |
| 4,085,934 A | | 4/1978 | Churchward | 273/171 |
| 4,630,825 A | | 12/1986 | Schmidt et al. | 273/167 H |
| 4,695,054 A | | 9/1987 | Tunstall | 273/171 |
| 4,867,458 A | | 9/1989 | Sumikawa et al. | 273/171 |
| 5,154,424 A | * | 10/1992 | Lo | 473/338 |
| 5,273,283 A | * | 12/1993 | Bowland | 473/338 |
| 5,518,243 A | * | 5/1996 | Redman | 473/334 |
| 5,547,427 A | | 8/1996 | Rigal et al. | 273/167 R X |
| 5,570,886 A | | 11/1996 | Rigal et al. | 273/167 R X |
| 5,582,553 A | * | 12/1996 | Ashcraft et al. | 473/338 |

FOREIGN PATENT DOCUMENTS

| | | |
|---|---|---|
| FR | 2689407 | 10/1993 |

* cited by examiner

*Primary Examiner*—William M. Pierce
(74) *Attorney, Agent, or Firm*—Greenblum & Bernstein, P.L.C.

(57) ABSTRACT

A golf club head having a body that includes a striking wall, an upper wall, and an open cavity. A housing is positioned within the cavity and it is removably attached in such position to the body. The housing has an asymmetrical configuration and is located in the open cavity of the body in a predetermined selected position and is removably connected to the body in the predetermined position. At least one balancing weight is located with respect to the housing in a predetermined selected position, the weight being non-removably connected to the housing by adhesive or by being molded in place, for example. A plurality of identically shaped housings, with differently positioned weights, can be provided to enable one to select a desired one of the housings to be fitted to the body of the club head to appropriately modify the behavior of the thusly assembled club.

20 Claims, 9 Drawing Sheets

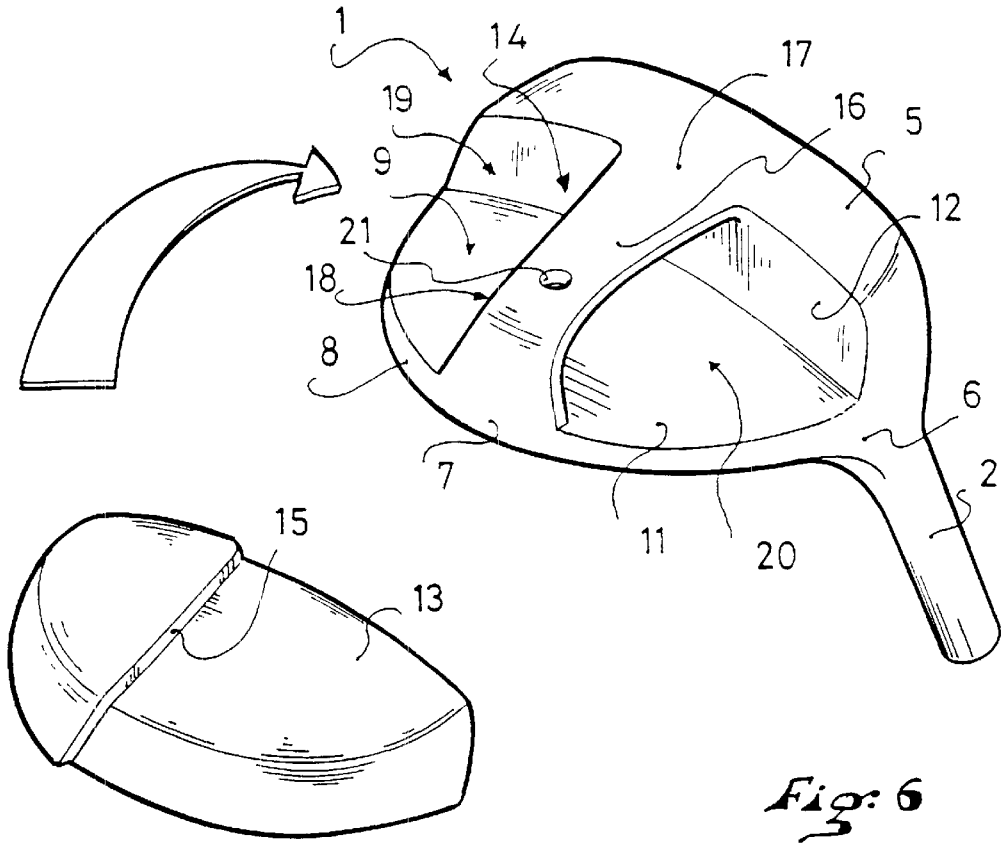
Fig: 6
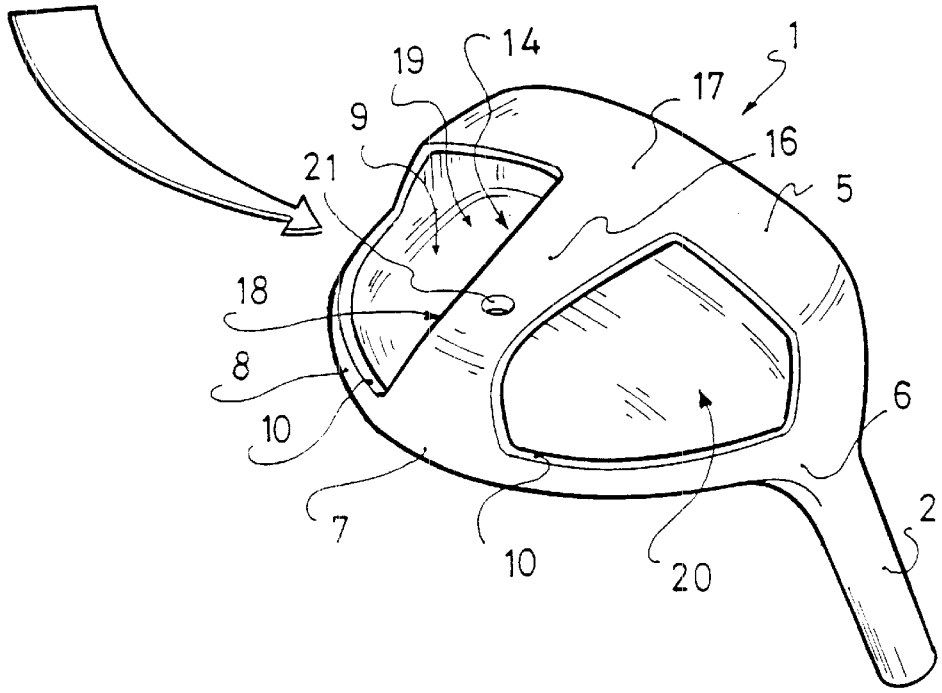

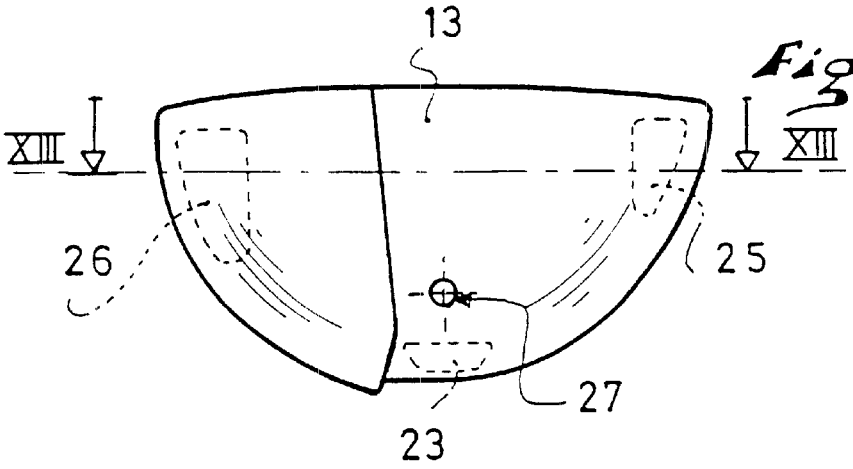
Fig: 11
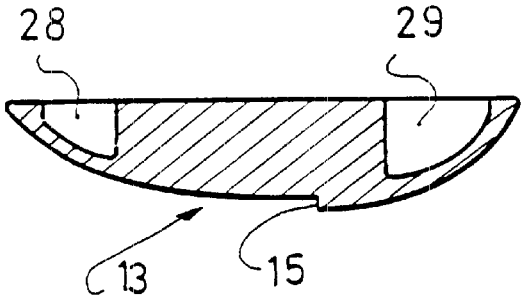
Fig: 12
Fig: 13
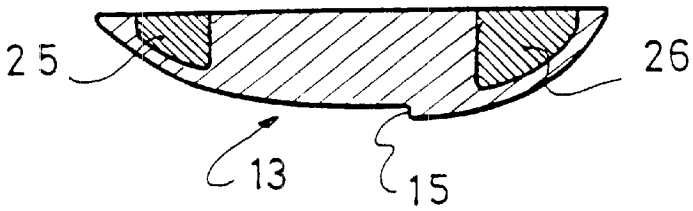
Fig: 14
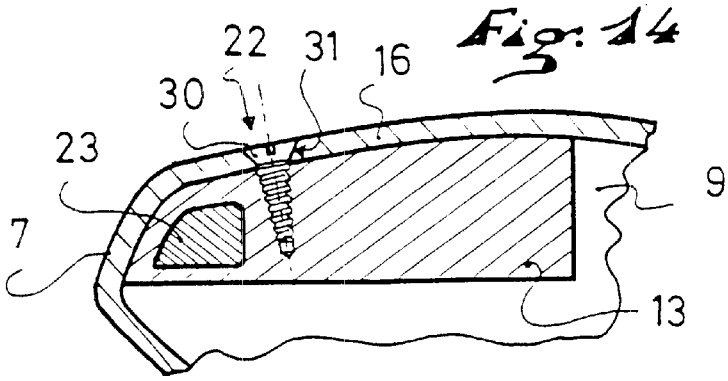

GOLF CLUB HEAD AND METHOD OF ASSEMBLING A GOLF CLUB HEAD

FIELD OF THE INVENTION

The present invention relates to the field of golf clubs.

The invention is more particularly related to a golf club head which includes, in particular, a detachable assembly of a recessed body and a housing.

DESCRIPTION OF BACKGROUND AND RELEVANT INFORMATION

Conventionally, each club of a series has a precise and defined geometry, such that a player can select a suitable club from the series, depending upon the conditions of the game.

However, for a given geometry, a player can be led to adjust the mechanical characteristics of his or her club, in order to improve its performance.

It is known that the distribution of the mass in the golf club head, within a volume defined by said head, has a considerable influence on the behavior of the club striking during a ball striking motion, commonly referred to as the swing.

Therefore, the prior art has proposed devices to enable a player to modify the distribution of mass in a golf club head.

In particular, the document U.S. Pat. No. 4,695,054 describes a golf club head which comprises especially a detachable block bored with two blind holes in which selected weights can be positioned. After the positioning of the weights, the block is fixed in a cavity of the head. The assembly obtained is a golf club head for which the position of the center of gravity contributes to attenuate, at least partially, the deficiencies due to the imperfect execution of the swing by the player.

A first drawback of such a structure is its complexity. It renders the necessary manipulations for the mounting and dismounting of the weights difficult.

In addition, these manipulations are time-consuming and tedious.

Another drawback originates from the structure of the block which can be mounted in the head in two different manners: a mounting error can lead a player to position the weights such that its swing deficiencies are accentuated, instead of being attenuated.

Another drawback is that the differences in the distribution of masses between the possible adjustments are very small, because the geometrical center of the head is located in the vicinity of the center of mass.

The document U.S. Pat. No. 4,630,825 describes a golf club head defining cavity closed by a removable plug. The plug is located along the length and at the lower portion of the head. The plug serves as a mass and can be made of various materials. A head according to this document allows neither a mass distribution that enlarges the size of the effective zone upon the impact of a ball on the head, nor an improvement to the lift of a ball on its trajectory.

SUMMARY OF THE INVENTION

In order to remedy these drawbacks, the golf club head according to the invention includes, on the one hand, at least one body comprising walls, in particular, including a striking wall and an upper wall, in which body an open cavity is provided, and includes, on the other hand, a housing to be nested and removably fixed in the cavity of the body and at least partially filling the cavity, the housing comprising at least one balancing weight, the weight being irremovably fixed with respect to the housing in a selected position, wherein the housing is asymmetrical and wherein the shape of the cavity is similar to that of the housing, so as to allow for only one mounting position of the housing in the cavity.

The complex manipulations imposed by the prior art in positioning the weights are eliminated: it suffices to replace a housing balanced in a certain manner by another housing balanced in a different manner.

The replacement is all the more easier because the housing is asymmetrical and the shape of the cavity is similar to that of the housing, so as to allow for only one position for mounting the housing in the cavity.

Without leaving the scope of the invention, one can provide to form an assembly comprising a golf club head and at least two housings, the head comprising a body in which an open cavity is provided, and each housing being asymmetrical and filling the cavity whose shape is similar to that of the housing, the assembly being such that the housings have the same shape and a different mass, only one of the housings being assembled with the head.

This assembly enables the player to select the housing that is best suited to adjust his or her trajectories by controlling the quality of the impact of a ball on the club head.

BRIEF DESCRIPTION OF THE DRAWINGS

Other characteristics and advantages of the invention will become apparent from the description that follows, with reference to the annexed drawings, and in which:

FIG. 6 shows that a housing comprising a ridge can be mounted on a head provided with an arch to partially or totally fill the cavity;

FIG. 11 is an external view of a housing according to a preferred embodiment;

FIG. 12 is a cross-section along the line XII—XII of FIG. 11, showing cavities of the housing prior to their filling;

FIG. 13 is similar to FIG. 12, but shows cavities of the housing after their filling;

FIG. 14 is a partial enlargement of FIG. 8;

DETAILED DESCRIPTION

Figure 1:
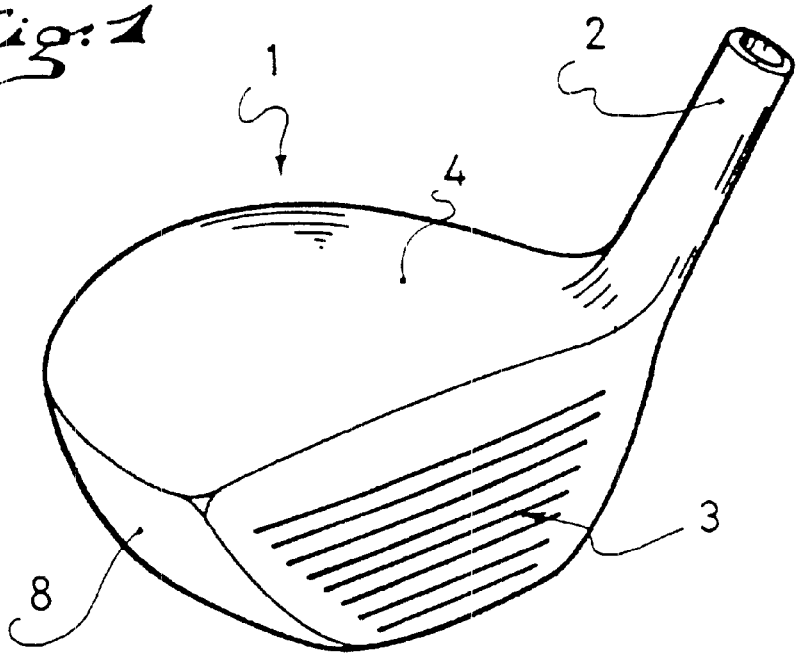
FIG. 1 is a perspective view of a conventional head.

FIG. 1 shows a head 1 affixed to one end of shaft 2, especially provided with a striking wall 3 and a top or upper wall 4.

Figure 2:
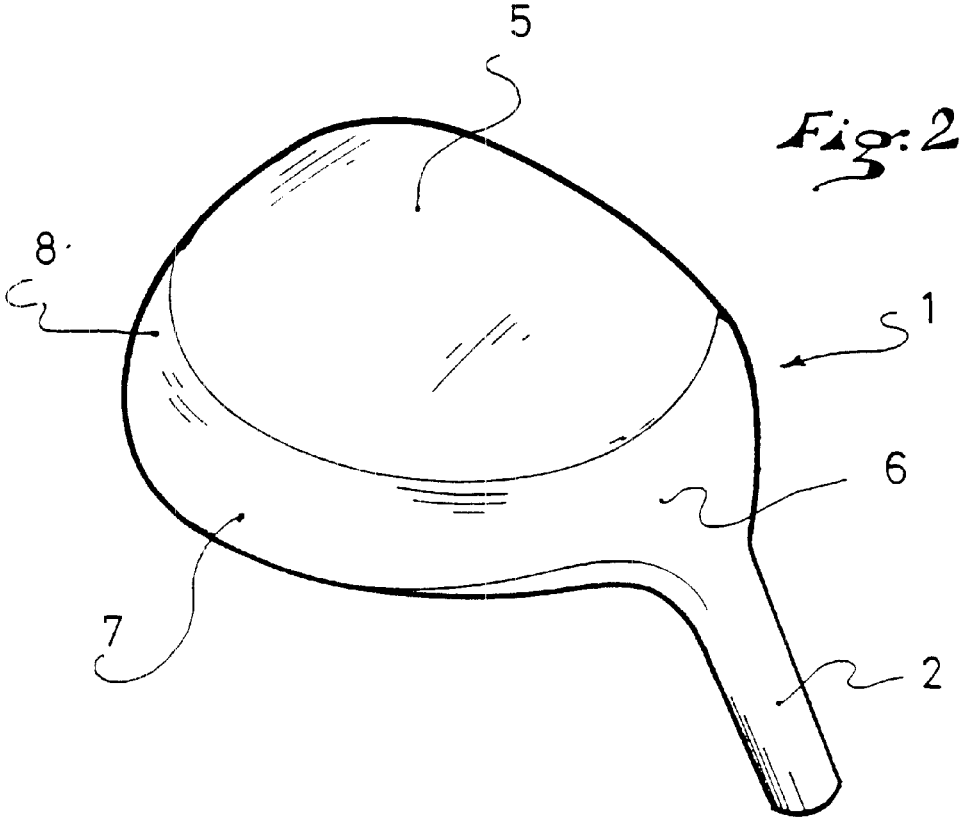
FIG. 2 is a perspective view of a head similar to that of FIG. 1, but from another angle.

The head 1 is also shown in FIG. 2, from a different angle, and show a wall 5 beneath the head, referred to as a lower wall or sole, as well as a lateral wall 6, a rear wall 7 and another lateral wall 8.

All of the walls 3, 4, 5, 6, 7 and 8 form the body of the head 1.

Figure 3:
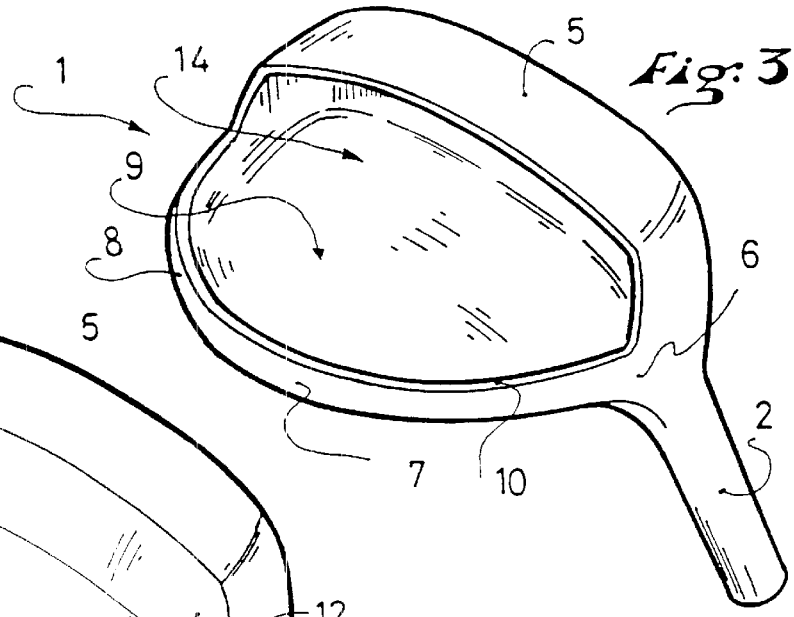
FIG. 3 is a perspective view of a recessed head.

FIG. 3 shows an example of cavity 9 obtained by successively cutting out the lower 5, lateral 6, rear 7 and lateral 8 walls. A recess defines the cavity 9 which, in this non-limiting example, has the particularity of extending deeply within the body of head 1. The cavity 9 whose peripheral edge 10 preferably has a constant thickness, can even be provided such that each of the walls 3, 4, 5, 6, 7 and 8, is fairly thin.

In a preferred embodiment, the average thickness of the walls 4, 5, 6, 7 and 8 will be on the order of 2 mm, and the thickness of the striking wall 3 will be comprised between 2 and 6 mm; these values being non-limiting for a head made of metal or composite material, for example.

Figure 4:
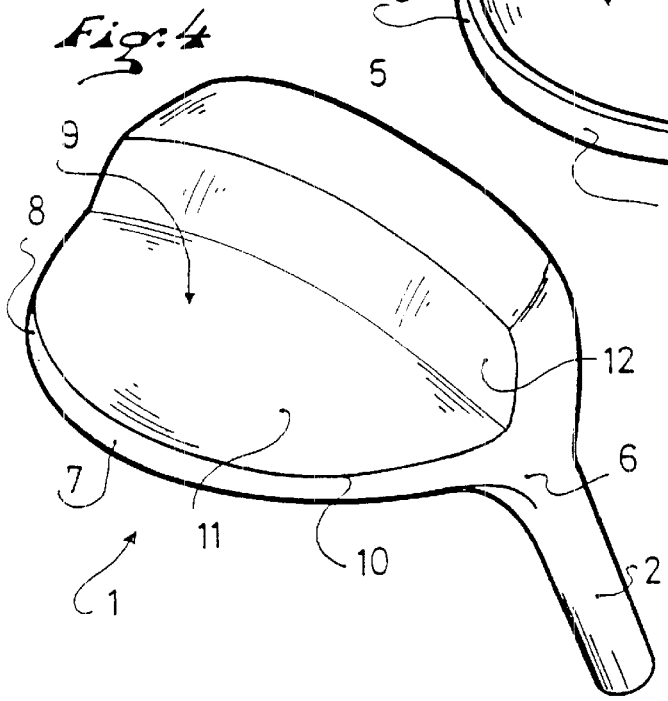
FIG. 4 is a perspective view of a recessed head, which is different from FIG. 3.

As shown in FIG. 4, the cavity 9 obtained after the recess is made can be substantially less deep than that of FIG. 3, and it can, for example, be at least partially demarcated by at least one wall, such as walls 11 and 12.

An example of embodiment of the head 1 according to FIG. 4 consists of filling a portion of the cavity 9, obtained as indicated and shown in FIG. 3, with a material such as a polyurethane foam. In this case, the walls 11 and 12 are made of foam.

Another example of embodiment of the head 1 whose cavity 9 is demarcated at least partially by walls, consists of attaching these walls on the peripheral edge 10 by any means such as adhesion, welding or the like.

Regardless of the volume of the cavity 9, and regardless of the material used and their arrangement, the golf club head 1 comprises at least two detachable elements, a body in which a cavity 9 is provided which communicates with the outside of the body through at least one opening 14 demarcated by the peripheral edge 10, and a housing 13 filling the cavity 9 at least partially, the body comprising especially walls, including a striking wall 3 and an upper wall 4, and the housing 13 comprising at least one balancing weight, which is particular in that the weight is irremovably fixed with respect to the housing 13 in a selected position.

Figure 5:
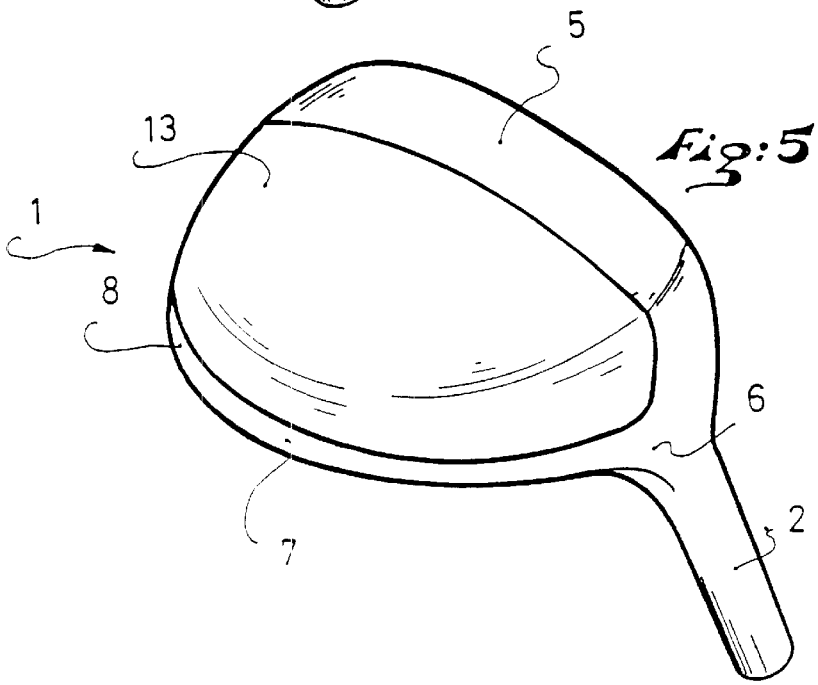
FIG. 5 is a perspective view of the assembly of a housing with a head similar to that of FIG. 3 or of FIG. 4.

FIG. 5 shows the housing 13, positioned in the cavity 9 of the head 1 such as shown in FIG. 3 or in FIG. 4. The housing 13 takes support either on at least one peripheral portion 10 of the peripheral edge of the cavity 9, or on at least one portion of the surface of walls 11 and 12.

The shape of the housing 13 provides the assembly of the recessed body of the head 1 and of the housing 13 with an aspect similar to that of a conventional golf club head shown in FIGS. 1 and 2.

The housing 13 is maintained on the remainder of the head 1 by any means, known to the one skilled in the art, that enables a disassembling of the assembly of the housing 13 and of the head 1.

According to a preferred embodiment, there exists only one position for the detachable assembly of the housing 13 on the head 1. In this regard, the housing 13 is asymmetrical and the shape of the cavity 9 is complementary to that of the housing 13, so as to allow for only one position for mounting the housing 13 in the cavity 9.

Preferably, the cavity 9 is formed in the rear lower portion of the head, by means of cutouts of the lower wall 5 or sole, as well as of the lateral walls 6 and 8 and of the rear wall 7. This localization has been shown in FIGS. 3, 4 and 5, but it is also visible in FIGS. 6, 7, 8, 9, 10, 14 and 19.

Indeed, it is very advantageous to distribute the mass of a golf head in certain zones, and especially on the sides or toward the rear of the head.

Masses positioned on the sides, in the vicinity of the lateral walls 6 and 8 make it possible to enlarge the size of the effective zone upon impact of a ball on the head 1, which is generally referred to as the sweet spot.

Masses positioned at the rear, in the vicinity of the wall 7, cause an increase in the inclination of the striking surface 3 during the swing. This phenomenon related to the centrifugal force, and referred to as the dynamic loft, improves the lift of a ball on its trajectory.

The housing 13 according to the invention will thus make it possible to remove or return masses in the head 1, in a precise and selected area.

According to the preferred mode of construction shown in FIG. 6, a head 1 and a housing 13 have complementary forms and are design to nest with one another by means of a manipulation imposed by the structure of the assembly. The housing 13 comprises a ridge 15 projecting on one of its surfaces, on the one hand, and the opening 14 is partially closed by an arch 16 which connects a front portion 17 of the sole 5 to the rear wall 7, on the other hand, such that the ridge 15 is in contact with the arch 16 after the mounting of the housing 13 in the cavity 9.

The arrows of FIG. 6 show that a housing 13 can be selectively mounted in a cavity 9 partially demarcated by the walls 11 and 12, or can be mounted by taking support on at least one peripheral edge 10 of a cavity 9 cut deeply into the head 1.

In each case, the ridge 15 of the housing 13 comes in abutment against a flank 18 of the arch 16. This arch 16 divides the peripheral edge 10 of the cavity 9 into two portions, to define two inlets 19 and 20 in this cavity 9.

The assembly thus constituted has the advantage of being rigid, and of allowing an easy and rapid positioning or removal of the housing 13 with respect to the head 1.

As will be seen hereinafter, a hole 21 in the arch 16 allows for passage of a screw 22, a rivet or any other detachable means.

Figure 7:
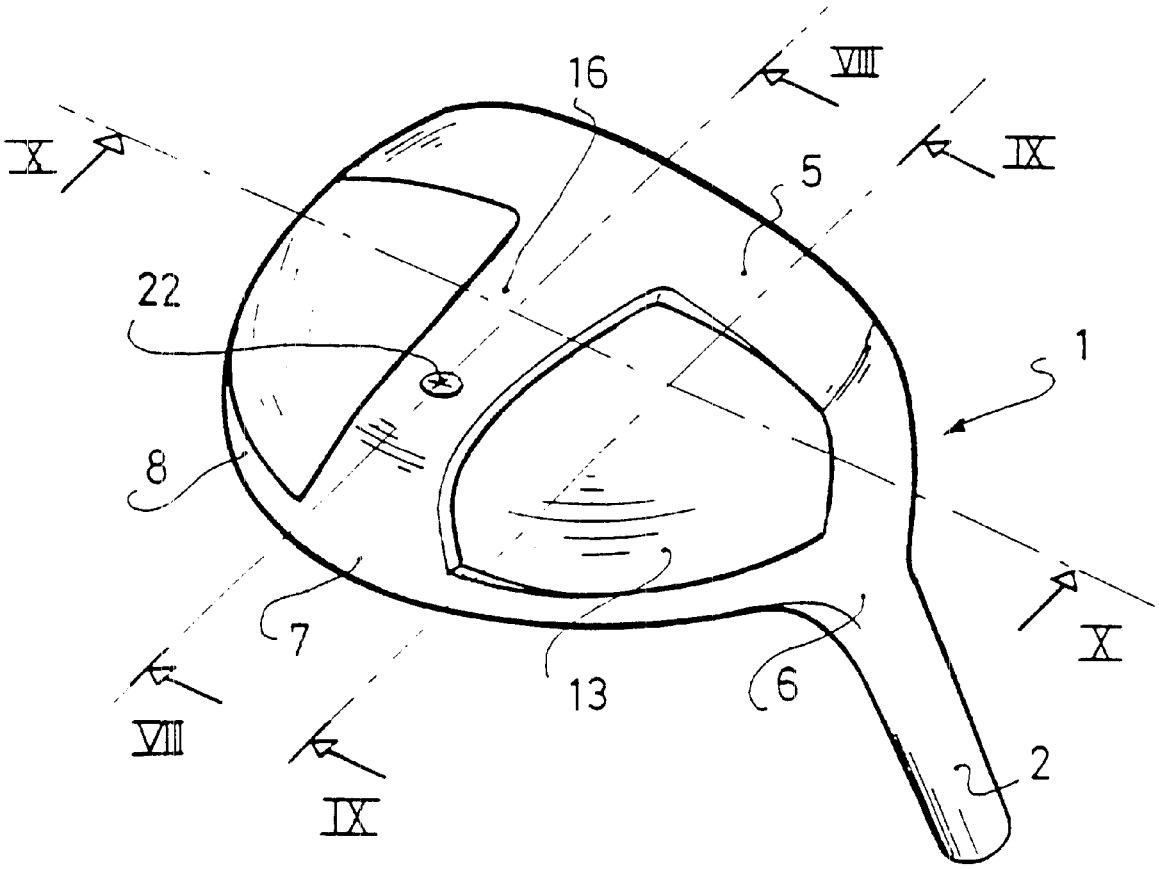
FIG. 7 is a perspective view of the assembly of a housing comprising a ridge with a head provided with an arch.

FIG. 7 shows an assembly of a head 1 with a housing 13 according to a preferred and non-limiting embodiment. The screw 22 is fixed in the housing 13 through the hole 21 of the arch 16. This arrangement prevents any relative displacement of the head 1 and of the housing 13.

Figure 8:
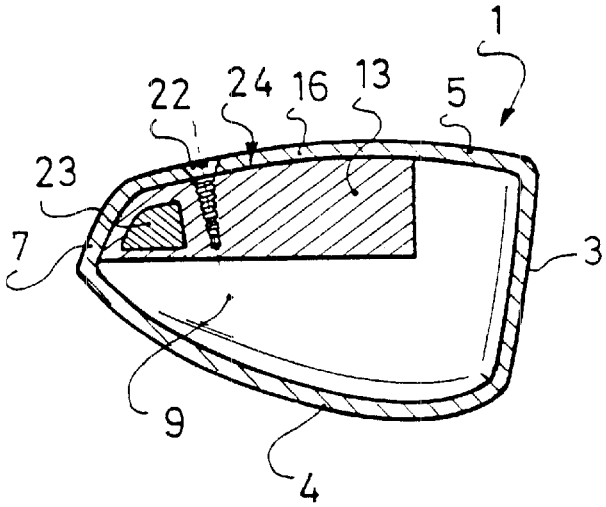
FIG. 8 is a cross-section along the line VIII—VIII of FIG. 7.

The cross-section along VIII—VIII shown in FIG. 8, along a substantially median plane of the head 1 and passing approximately in the middle of the arch 16, shows by way a non-limiting example, the arrangement of a weight 23 in the housing 13 at the rear of the head 1. The weight 23 is fixed in a cavity of the housing 13 via a means which will be described subsequently. Preferably, the housing 13 is in contact with the arch 16 along a contact surface 24. The screw 22 maintains the housing 13 in a fixed position. In this example, the cavity 9 is filled only partially by the housing 13.

Figure 9:
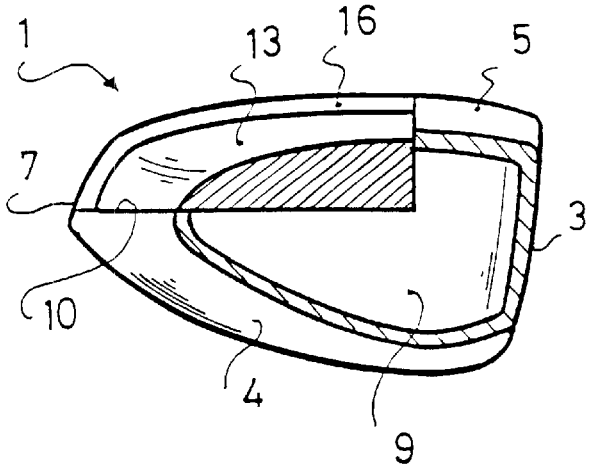
FIG. 9 is a cross-section along the line IX—IX of FIG. 7.
Figure 10:
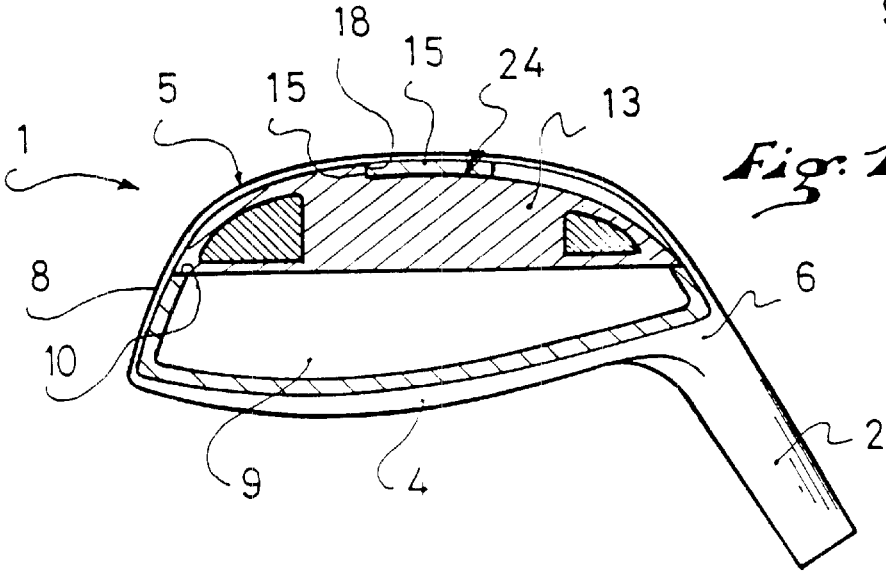
FIG. 10 is a cross-section along the line X—X of FIG. 7.

As shown in FIGS. 9 and 10, the housing 13, according to the same non-limiting example of FIG. 8, is in support especially on the peripheral edge(s) 10. A very precise positioning is advantageously obtained by contact of the ridge 15 of the housing 13 on the arch 16 of the head 1.

A complementary function of the intersection of the ridge 15 with the arch 16 is to allow for only one direction for mounting or dismounting the housing 13 with respect to the head 1.

A complementary function of the arch 16 is to absorb the possible shocks during the swing and to protect the housing 13.

This housing 13 can be made out of any material, such as metal, plastic, wood or other materials. However, it is preferably made of a low density material, such as aluminum, plastic or a low density resin.

One or more weights are arranged in this housing 13 in selected areas. An example of arrangement is proposed in FIG. 11, where the housing 13 is seen from the side of the ridge 15 with three weights 23, 25, 26, inserted in three cavities shown in dotted lines, and a hole 27 for receiving the screw 22.

Various m o des are possible for affixing a weight on or in a housing 13.

For example, a weight can be fixed to the housing 13 by means of a layer having adhesive properties. This is the known adhesion technique.

Possibly, a melted metal can be cast directly in a cavity of the housing 13.

For example, the lead used as a mass assumes the forms of a housing 13 made of epoxy resin, and possibly enables an undercut molding.

Regardless of the process, each weight can be confined in a closed cavity of the housing 13. It suffices that the weight be embedded in the constituent material of the housing 13.

FIGS. 12 and 13 are cross-sections of the housing 13 according to a non-limiting example. Two lateral cavities 28 and 29 of the housing 13 have been filled by two lateral masses or weights 25 and 26. These weights adhere to the walls of the cavities 28 and 29 as has been explained previously.

FIG. 14 is a partial enlargement of FIG. 8 which shows a rear weight 23 and the immobilization of the housing 13 by means of a screw 22 with a countersunk head 30. This countersunk head 30 makes it possible to obtain a good tightening because its conical shape becomes easily stuck on the walls 31 of the hole 21 of the arch 16.

Now, independently of techniques for fixing the weight(s) with respect to the housing 13, various structures help in selecting zones or cavities for receiving these weights. The goal is to obtain a housing 13 that is specifically balanced and whose center of gravity is selectively positioned with respect to the geometrical center. Since the housing is then mounted in a precise and unique manner in the head 1, the latter will in turn have a center of mass selectively positioned with respect to its geometrical center. The choice of a housing 13 for assembly in the head 1 is interesting because it enables a player to modify characteristics for balancing masses in the head of his or her club, without influencing the other characteristics.

The player advantageously modifies his or her ball trajectories by only changing the housing 13; this adjustment system allows for better sensations.

This solution has a major psychological advantage because the golf player maintains an equipment to which he is accustomed.

This solution also has an economical benefit, because the price of a housing is substantially lower than that of a head or of a club.

A few examples of housing structures are shown in succession in FIGS. 15, 16, 16, 17, and 18.

Figure 15:
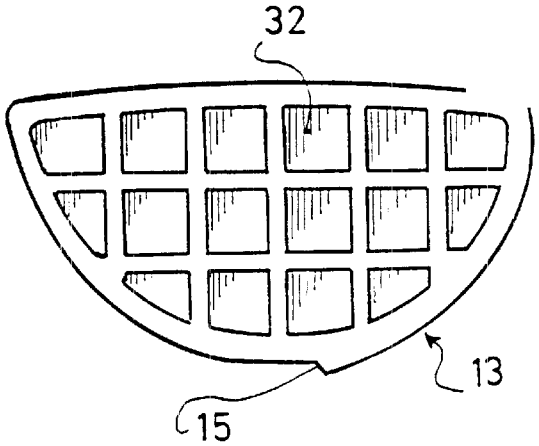
FIG. 15 schematically shows a possible architecture to define cavities in a housing.

FIG. 15 proposes a plurality of cavities 32 defined in the housing 13 to form at least one receiving cell for a weight.

The advantage is that it suffices to select those of the cavities 32 that one desires to weigh down. Another advantage is the ease with which series of housings with selected characteristics are produced.

Figure 16:
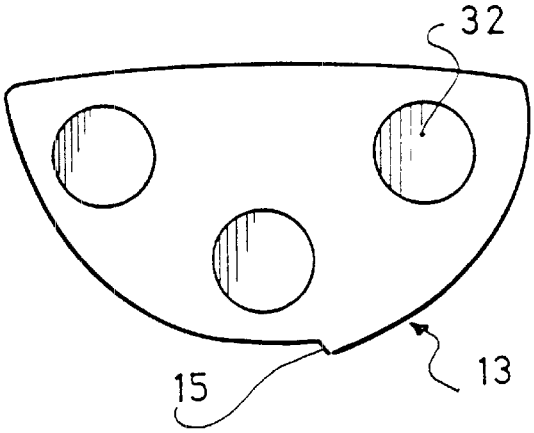
FIG. 16 shows another arrangement of the cavities.

FIG. 16 proposes a simplified architecture that has the advantage of being very economical: three blind holes serve as receiving cavities 32 for masses. Each cavity of the housing is made at a selected location for positioning a weight which, preferably, fills this cavity integrally .

Figure 17:
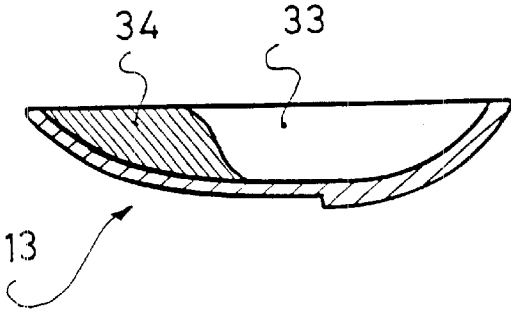
FIG. 17 is a cross-section of the housing defining a single cavity partially filled with a mass.
Figure 18:
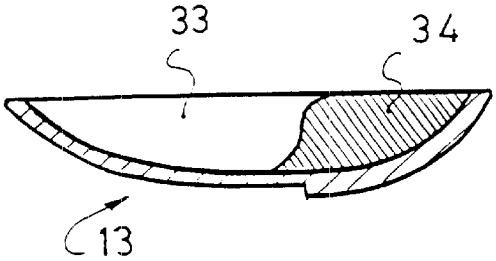
FIG. 18 is equivalent to FIG. 17.

Another configuration proposes a single cavity 33 in a housing 13, as shown in FIGS. 17 and 18.

A mass 34 is fixed in a selected zone of the cavity 33. This is, for example, melted lead, reinforced resin, or any material.

Advantages of this configuration are essentially its extreme simplicity and the ease of implementation thereof: the single cavity is partially filled by a weight 34.

One can provide to fill the volume of the cavity 33 that is not filled by the weight 34, by a low density plastic material such as a polyurethane foam.

By low density is meant a density less than 1 $kg/dm^3$.

It is possible to imagine an infinite number of alternative embodiments. A common point to all these alternative embodiments is the possibility of placing a seal at least partially in contact with both the housing and the head. This seal is preferably a silicone-based paste, for example, and extends along the peripheral edge 10 of each opening 14 or inlet 19, 20 of the head 1.

This seal ensures sealing functions if the portion of the cavity 9 that is not occupied by the housing is neither filled with a material such as foam, nor separated from the housing by walls.

The advantage is that foreign bodies, such as water or dust, cannot fill this space in the cavity 9.

Furthermore, the seal advantageously plays the role of absorbing the vibrations that propagate in the head 1 during the impact of a ball on the striking surface 3.

Finally, a major interest in the invention resides in the possibility of constituting an assembly comprising a single head 1 and at least two housings 13, all of the housings having an identical shape and a different localization for their center of mass, only one of the housings being assembled with the head.

Figure 19:
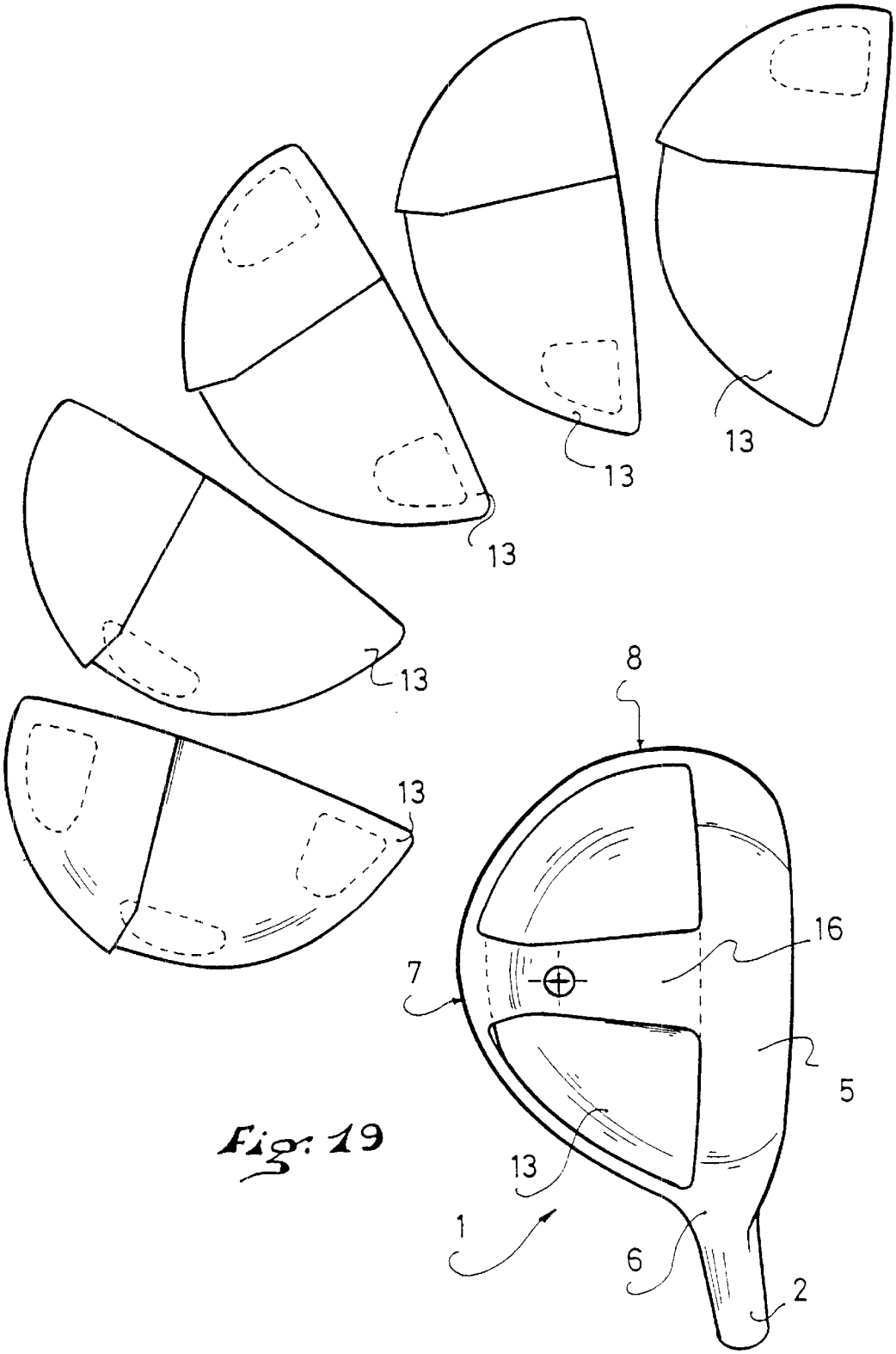
FIG. 19 gives an example of an assembly constituted by one head and a plurality of housings having an identical shape and a different positioning of the weights.

An example of an assembly of a head 1 and of six different housings 13 is provided in FIG. 19.

Advantageously, a player can change a housing 13, thereby changing the behavior of his or her club, to compensate for the imperfections in the swing.

His or her performance will therefore be improved.

The mass of a head 1 associated with a housing 13 will, for example, be on the order of 200 g, the body of the head 1 substantially weighing 140 g and the housing 13 weighing 60 g. However, the mass of the weight(s) inserted in the housing will preferably be close to 50.

These weight values offer a host of adjustment possibilities.

Of course, the invention is not limited to the embodiments thus described, and comprises all of the technical equivalents that fall within the scope of the following claims.

Figure 20:
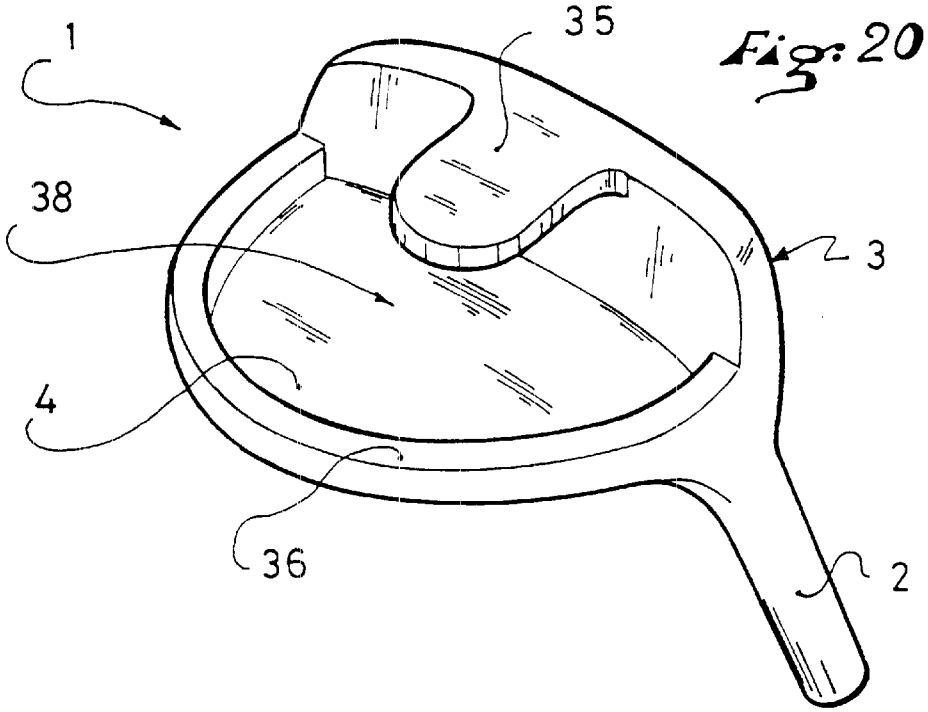
FIG. 20 is a perspective view of a recessed head according to an alternative embodiment.
Figure 21:
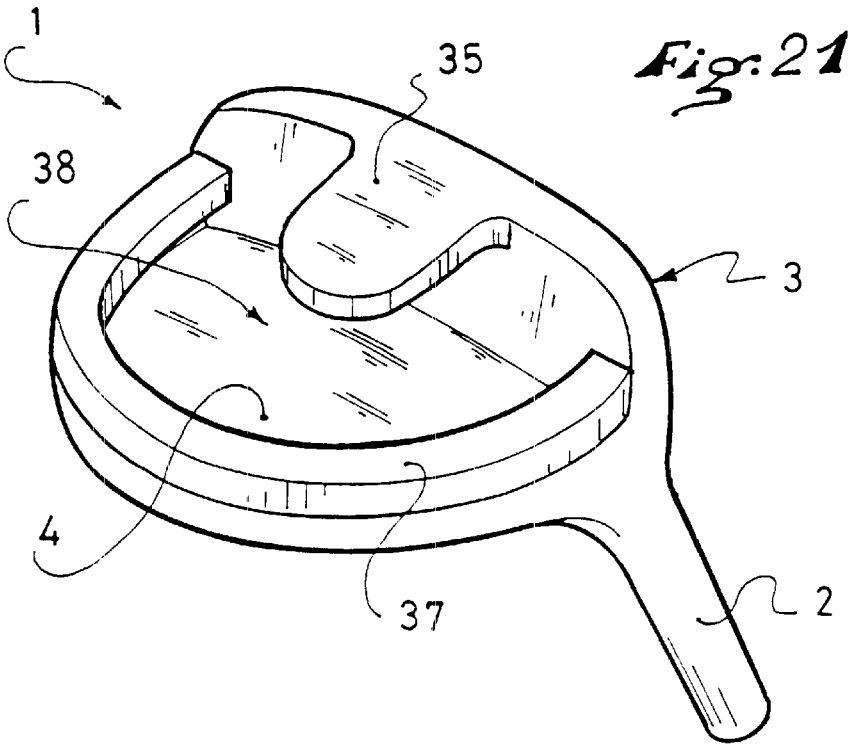
FIG. 21 is a view of a head similar to that of FIG. 20, on which a housing is connected.

In particular, one can imagine a golf head similar to that shown in FIGS. 20–21.

The head 1 is recessed so as to essentially maintain the most functional portions including, in particular, the striking wall 3, the upper wall 4, the end of the shaft 2, and a tongue 35 which plays the role of the sole 5.

A curved edge 36 of the upper wall 4 is adapted to receive a housing 37 whose shape is similar to that of a crescent and substantially complementary to the curved edge 36. The housing 37 does not completely fill an open cavity 38 demarcated by the striking surface 3, the upper wall 4 and the tongue 35. In accordance with the spirit of the invention, the housing 37 is removably maintained on the curved edge 36 and makes it possible to distribute the masses on the sides and to the rear of the head 1. The housing 37 can comprise masses, as previously described. The housing 37 can also be a piece made of a single material whose cross section varies along the curved edge 36.

What is claimed is:

1. A golf club head comprising:

a body, said body including an upper wall and a striking wall, said body further having an open cavity spaced rearwardly of said striking wall; and a housing having an asymmetrical configuration, said housing being located in said open cavity of said body in a predetermined selected position, said housing being removably affixed to said body in said predetermined position; and at least one balancing weight located with respect to said housing in a predetermined selected position, said weight being non-removably connected to said housing in said predetermined selected position.

2. A golf club head according to claim 1, wherein:

said body further comprises a lower wall, a rear wall, and a pair of opposite lateral walls; and said open cavity is open in a lower rear portion of said lower wall, said lateral walls, and said rear wall.

3. A golf club head according to claim 1, wherein:

said at least one balancing weight is connected to said housing with at least one layer of adhesive material to facilitate non-removability of said weight from said housing.

4. A golf club head according to claim 1, wherein:

said at least one balancing weight is a metallic material affixed to said housing by having been directly cast in a cavity of said housing to facilitate non-removability of said weight from said housing.

5. A golf club head according to claim 1, wherein:

said at least one balancing weight is embedded within a closed cavity of said housing to facilitate non-removability of said weight from said housing.

6. A golf club head according to claim 1, wherein:

said housing comprises a cavity; and said balancing weight only partially fills said cavity.

7. A golf club head according to claim 1, wherein:

said housing comprises a plurality of cavities, each of said plurality of cavities being adapted to receive a said balancing weight; and each of said at least one balancing weight is positioned in a respective one of said pluralities of cavities.

8. A golf club head according to claim 1, wherein:

said housing comprises at least one cavity located at a predetermined selected position; and said balancing weight integrally fills said cavity of said housing.

9. A golf club head according to claim 1, wherein:

said housing comprises a plurality of cavities forming a series of weight-receiving cells; and said at least one balancing weight comprises a plurality of weights, each of said plurality of weights being positioned within a respective one of said weight-receiving cells.

10. A golf club head according to claim 1, further comprising:

a seal extending along a peripheral edge of said open cavity and in contact with said housing and said body of said head.

11. A golf club head comprising:

a body, said body including an upper wall and a striking wall, said body further having an open cavity;

a housing having an asymmetrical configuration, said housing being located in said open cavity of said body in a predetermined selected position, said housing being removably connected to said body in said predetermined position: and at least one balancing weight located with respect to said housing in a predetermined selected position, said weight being non-removably affixed to said housing in said predetermined selected position said body further comprises a lower wall, a rear wall, and a pair of opposite lateral walls;

said open cavity is open in a lower rear portion of said lower wall, said lateral walls, and said rear wall;

said housing comprising an outer surface and a ridge projecting from said outer surface;

said lower wall comprising a surface having an opening connecting to said open cavity and an arch extending from a front portion of said lower wall to said rear wall; and said ridge being in contact with said arch when said housing is located in said predetermined position.

12. A golf club head according to claim 11, wherein:

said at least one balancing weight is connected to said housing with at least one layer of adhesive material to facilitate non-removability of said weight from said housing.

13. A golf club head according to claim 11, wherein:

said at least one balancing weight is a metallic material affixed to said housing by having been directly cast in a cavity of said housing to facilitate non-removability of said weight from said housing.

14. A golf club head according to claim 11, wherein:

said at least one balancing weight is embedded within a closed cavity of said housing to facilitate non-removability of said weight from said housing.

15. A golf club head assembly comprising:

a body, said body including an upper wall and a striking wall, said body further having an open cavity spaced rearwardly of said striking wall; and a plurality of housings, each of said housings being adapted to be removably located in said open cavity of said body in a predetermined selected position;

each of said plurality of housings having at least one balancing weight non-removably connected thereto and located in a respectively different predetermined selected position;

each of said plurality of housings having an identical asymmetrical shape, whereby said body of said head is adapted to be assembled with only one of said housings.

16. A golf club head assembly according to claim 15, wherein:

said at least one balancing weight of each of said housings is connected to said housing with at least one layer of adhesive material to facilitate non-removability of said weight from said housing.

17. A golf club head assembly according to claim 15, wherein:

said at least one balancing weight of each of said housings is a metallic material affixed to a respective housing by having been directly cast in a cavity of said housing to facilitate non-removability of said weight from said housing.

18. A golf club head assembly according to claim 15, wherein:

said at least one balancing weight is embedded within a closed cavity of said housing to facilitate non-removability of said weight from said housing.

19. A method of balancing a golf club head comprising:

providing an assembly comprising a body having a striking wall and a cavity spaced rearwardly of said striking wall;

providing at least two housings adapted to fit within said cavity of said body, each said housing comprising at least one balancing weight non-removably fixed in a predetermined position in said housing, said housings having an identical shape but a different predetermined position of said at least one balancing weight; and selecting one housing of said assembly having a desired weighting configuration, resulting from said predetermined position of said balancing weight, and fitting said selected one housing within said cavity of said body.

20. A method of balancing a golf club head consisting of:

providing an assembly comprising a body having a striking wall and a cavity spaced rearwardly of said striking wall;

providing at least two housings adapted to fit within said cavity of said body, each said housing comprising at least one balancing weight non-removably fixed in a predetermined position in said housing, said housings having an identical shape but a different position of said at least one balancing weight; and selecting one housing of said assembly having a desired weighting configuration, resulting from said predetermined position of said balancing weight, and fitting said selected one housing within said cavity of said body.

* * * * *